US007887642B2

(12) United States Patent
Jerg et al.

(10) Patent No.: US 7,887,642 B2
(45) Date of Patent: Feb. 15, 2011

(54) DISHWASHER WITH INTEGRATED SPRAY CHANNELS

(75) Inventors: Helmut Jerg, Giengen (DE); Hans-Peter Nannt, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 861 days.

(21) Appl. No.: 10/575,176

(22) PCT Filed: Oct. 8, 2004

(86) PCT No.: PCT/EP2004/011270

§ 371 (c)(1),
(2), (4) Date: Apr. 7, 2006

(87) PCT Pub. No.: WO2005/034712

PCT Pub. Date: Apr. 21, 2005

(65) Prior Publication Data

US 2007/0074746 A1 Apr. 5, 2007

(30) Foreign Application Priority Data

Oct. 8, 2003 (DE) ..... 103 46 676

(51) Int. Cl.
*B08B 3/00* (2006.01)

(52) U.S. Cl. ..... 134/56 D; 134/57 D; 134/58 D; 134/172; 134/177; 134/198

(58) Field of Classification Search ..... 134/56 D, 134/57 D, 58 D, 172, 177, 198
See application file for complete search history.

(56) References Cited

U.S. PATENT DOCUMENTS 2,630,813 A 3/1953 Murdoch
3,777,989 A * 12/1973 Pacella et al. ..... 239/567
3,884,263 A * 5/1975 Wright ..... 137/571
5,409,026 A 4/1995 St. Martin (Continued)

FOREIGN PATENT DOCUMENTS

CH 692 436 6/2002

(Continued)

OTHER PUBLICATIONS

International Search Report PCT/EP2004/011270.

*Primary Examiner*—Michael Barr
*Assistant Examiner*—Jason Heckert
(74) *Attorney, Agent, or Firm*—James E. Howard; Andre Pallapies

(57) ABSTRACT

A device for spraying spray products in a dishwasher enables the dishes to be impinged upon with dishwashing fluid in an efficient manner and to avoid wear and tear caused by moving parts and to provide trouble-free operation. The spraying device sprays dishwashing fluid into the inside of the washing container and includes at least one spray channel that guides at least one dishwashing liquid and is integrated into the bottom, top and/or wall area of the washing container, whereby openings which are oriented toward the interior of the washing container are provided on one side and enable the dishwashing fluid to pass therethrough. An improved more homogeneous distribution of dishwashing fluid is provided and it is possible to dispense with moving parts, such as spray arms for the distribution of dishwashing fluid, leading to greater freedom in terms of washing container and wash basket design.

12 Claims, 5 Drawing Sheets

Figure 1:
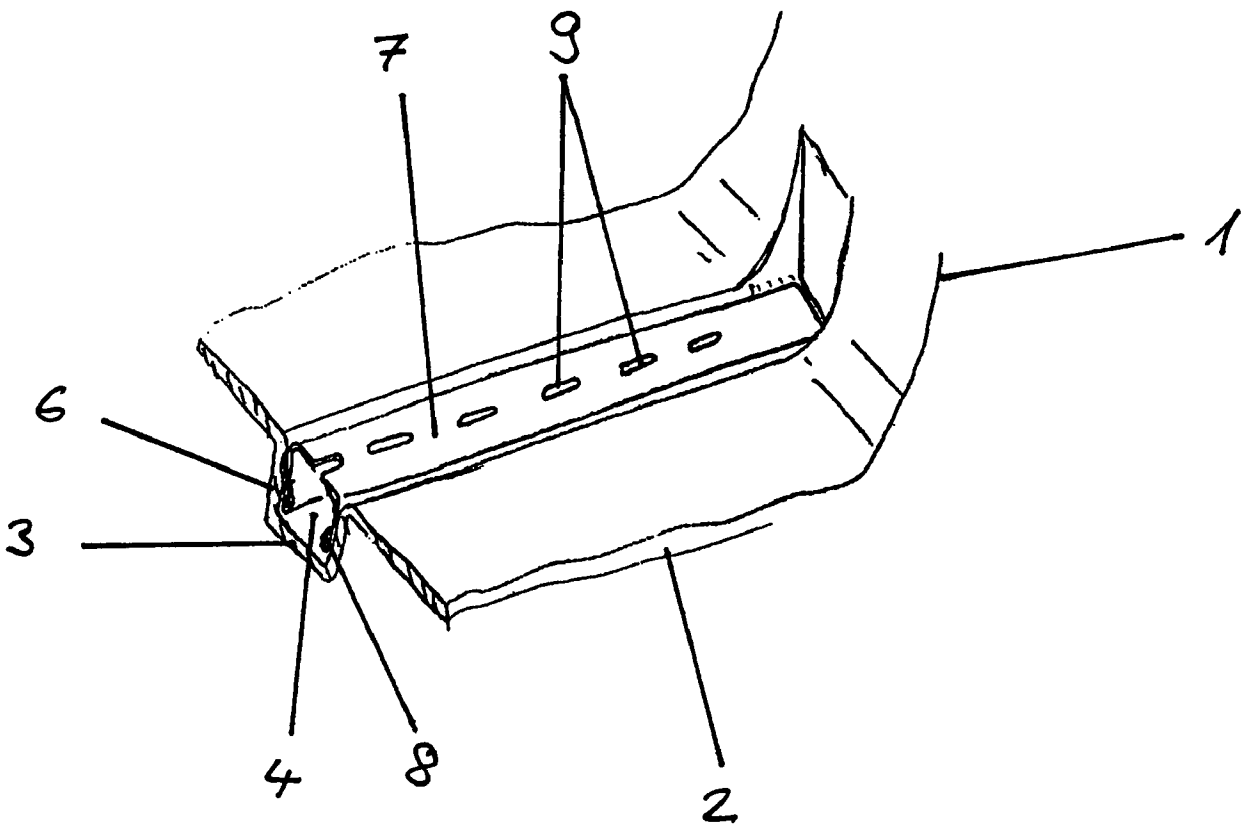

U.S. PATENT DOCUMENTS 6,869,029 B2 * 3/2005 Ochoa et al. ..... 239/380

FOREIGN PATENT DOCUMENTS

| | | | |
|---|---|---|---|
| DE | 1 103 787 | | 3/1961 |
| DE | 1 847 897 | | 3/1962 |
| DE | 1926 024 | | 11/1969 |
| DE | 197 20 759 | | 11/1998 |
| DE | 20007044 | * | 4/2000 |
| DE | 200 07 044 | | 7/2000 |
| EP | 0 858 768 | | 8/1998 |
| FR | 1 265 156 | * | 4/1958 |
| FR | 1.265.156 | | 6/1961 |
| FR | 2 784 886 | | 4/2000 |
| GB | 949954 | | 2/1964 |
| GB | 1138291 | * | 12/1968 |
| GB | 2 142 224 | | 1/1985 |
| WO | WO 03/051172 | | 6/2003 |

* cited by examiner 1
2
3
3
3
4
5
7

DISHWASHER WITH INTEGRATED SPRAY CHANNELS

The invention relates to a dishwasher comprising one or more washing containers and a device for spraying items to be washed disposed in the washing container.

Dishwashers with spray devices which operate with rotating spray arms are known. Since in conventional dishwashers the washing container usually has a rectangular outline whereas the rotating spray arms have a circular range of action, the respective corner regions can only be inadequately sprayed with spray liquid by the rotating spray arms. In addition, rotating spray arms have the disadvantage that there are moving parts which are subjected to motion-induced wear and also an increased liability to break down if, for example, items to be washed which have entered into the range of movement of the spray arm obstruct the rotation of the spray arm.

Dishwashers with spray devices are also known in the prior art wherein the items to be washed located in the washing container are exposed to the action of washing liquid via fixed spray nozzles or sprinklers. These spray devices have the disadvantage that they project into the interior of the washing container and the emerging spray jet has a pre-determined direction so that a uniform cleaning effect of the items to be washed cannot be ensured.

It is thus the object of the present invention to provide a dishwasher with a space-saving device for spraying items to be washed wherein the washing liquid is sprayed as uniformly as possible in the washing container in order to efficiently act on the items to be washed with washing liquid and the wear caused by moving parts and the liability to breakdown is eliminated.

The dishwasher according to the invention comprises at least one washing container and a spraying device for spraying washing liquid into the interior of the washing container wherein the spraying device comprises at least one spray channel which guides at least one washing liquid, which is integrated in the bottom, top and/or wall area of the washing container and which has openings for the passage of washing liquid on a side directed towards the interior of the washing container.

An advantage of the dishwasher with a spray device according to the present invention consists in the fact that the uniform spray distribution of the washing liquid in the washing container is improved by the spray channel being integrated in the bottom, top or wall area of the washing container. Secondly, in the dishwasher according to the invention no moving components e.g. spray arms are required and as a result, motion-induced wear or the liability of moving parts to break down is eliminated. This has the consequence that falling crockery items, for example, no longer disturb the spray distribution of the washing liquid since mechanically moving parts which could be obstructed in their area of movement are no longer present.

Since no rotating spray arms are required, this also results in the advantage that the available space for arranging the items to be washed in the washing container is enlarged. The crockery items can be arranged very close to the bottom, top or wall area of the washing container since freedom of movement for a rotating spray arm no longer needs to be taken into account. In addition, the freedom in the configuration of the crockery baskets located in the washing container is also greater since no rotating spray arms or components projecting from the bottom, top or wall areas of the washing container need to be taken into account for the distribution of the washing liquid.

Another advantage of the spray device of the dishwasher according to the invention is that the length and width of the washing container no longer need necessarily be constructed in a ratio of at least approximately 1:1, as is required for example in a spray device with rotating spray arms, but can be configured in almost any shape since the spray channels integrated in the bottom, top and/or wall area of the washing container can be suitably matched to any shape of the washing container.

In order to configure the spray distribution of the spraying liquid inside the washing container as optimally as possible, the shape and/or the number of openings for the passage of washing liquid is preferably determined so that the desired washing is achieved in the interior of the washing container. In this case, a spray distribution as uniform as possible or a non-uniform spray distribution can be strived for, where certain areas in the washing container are washed more intensely than others.

In a preferred embodiment of the dishwasher with a spray device according to the present invention, the at least one spray channel is constructed as tubular and preferably has two open ends via which the washing liquid can be supplied under the action of pressure. In this way, washing liquid under pressure can be supplied to both ends of the tubular spray channel independently of one another. In this case, the washing liquid is supplied to the spray channel by a pumping device such as a circulating pump of the dishwasher, for example. More appropriately, the pressure at which the washing liquid is supplied to the spray channel via its one end or via both its ends can be varied. That is, either the pressure for supplying washing liquid only via one end of the spray channel or the pressure for supply washing liquid via both ends of the spray channel can be varied.

By supplying washing liquid to the spray channel at a time-variable pressure, it is possible to produce spray patterns which can be matched to specific items to be washed for example. The spray patterns are formed by the different pressure distribution of the washing liquid in the spray channel which is obtained as a result of the time variation of the pressure at which the washing liquid is supplied via the two ends of the spray channel where the liquid pressure produced at one end of the spray channel differs from the liquid pressure at the other end of the spray channel. As a result, jets of washing liquid of different intensity emerge at different pressure from the openings of the spray channel in the interior of the washing container. As a result of the different application of pressure at the ends of the spray channel, the pressure maximum in the spray channel, i.e., the location along the channel at which the emerging jet possesses its maximum impelling force, can be varied.

The variation of the pressure at which the washing liquid is supplied to the spray channel can be controlled by a pressure distribution using electronic, hydraulic and/or mechanical means. The use of an electronically controlled pressure distribution has the advantage that again no rotating or moving components are required since both the spray intensity and the spray pattern are controlled by means of a controlled pressure sequence and pressure control. In this case, a plurality of different spray patterns can be produced according to a choice of washing program. When selecting the spray patterns, it is possible to take into account the different contamination states and the type of items to be washed.

In a further preferred embodiment of the present invention the side of the spray channel directed towards the interior of the washing container lies substantially in one plane with the bottom, top or wall surface of the washing container directed towards the interior of the washing container in which the spray channel is integrated. As a result, flat surfaces are obtained at the bottom, top or wall area of the container which on the one hand provide a pleasing visual appearance and on the other hand, make it possible to arrange items to be washed in the immediate vicinity of the bottom, top or wall area of the washing container.

The spray channel more preferably has a round, preferably circular round cross-section. The hydraulic losses can thus be kept low.

To complete the design advantages, the spray channel can have a rectangular, preferably substantially square cross-section where one side of the spray channel is directed towards the interior of the washing container. It is especially advantageous if the spray channel is constructed such that it can be released manually from the bottom, top or wall area of the washing container and is preferably fixed in the bottom, top and/or wall area of the washing container by means of a clamp connection. By this means the spray channel can be removed from the washing container as required to free it from deposits for example. However, it can also be replaced by another spray channel with different openings for the emergence of washing liquid to obtain a different spray pattern.

Alternatively or additionally, a wall of the spray channel directed towards the interior of the washing container can be constructed such that it can be released manually and is preferably fixed in the bottom, top and/or wall area of the washing container on the spray channel by means of a clamp connection. The removable side of the spray channel enables this to be removed like a cover from the spray channel in order to gain access to the interior of the spray channel. In this case, it is particularly useful if the removable side of the spray channel is also the side which has the openings for passage of the washing liquid from the spray channel into the interior of the washing container. As a result, if necessary only the top of the spray channel can be removed to free the openings from deposits, to inspect the interior of the spray channel or to replace it by another top.

However, the side of the spray channel directed towards the interior of the washing container can also be formed by the top, wall and/or the bottom of the washing container, wherein the top, the wall and/or the bottom have openings for passage of the washing liquid in the area of the spray channel. In this embodiment, at least the side of the spray channel directed towards the interior of the washing container and the top, the wall and/or the bottom of the washing container is constructed as one piece. Since the washing container is usually made of plastic, the openings for passage of the washing liquid can either be inserted subsequently or provided during the manufacture of the washing container. In addition, the entire spray channel with the top, the wall and/or the bottom of the washing container can also be constructed as one piece and can be provided during the manufacture of the washing container.

In an especially advantageous embodiment of the dishwasher according to the invention, the washing container is constructed as trough-like and a number of spray channels preferably aligned parallel to one another are integrated at least in the bottom of the washing container. The number of spray channels is fundamentally determined according to the volume of the washing container or the surface of the dishwasher bottom. The installation of a plurality of spray channels promotes a uniform spray distribution of the washing liquid in the washing container and prevents spray jets from being "shaded" by the items to be washed. In this case, the bottom of the washing container can be shaped so that the spray channels lie on different levels and thus a plurality of spray levels are formed.

Figure 3:
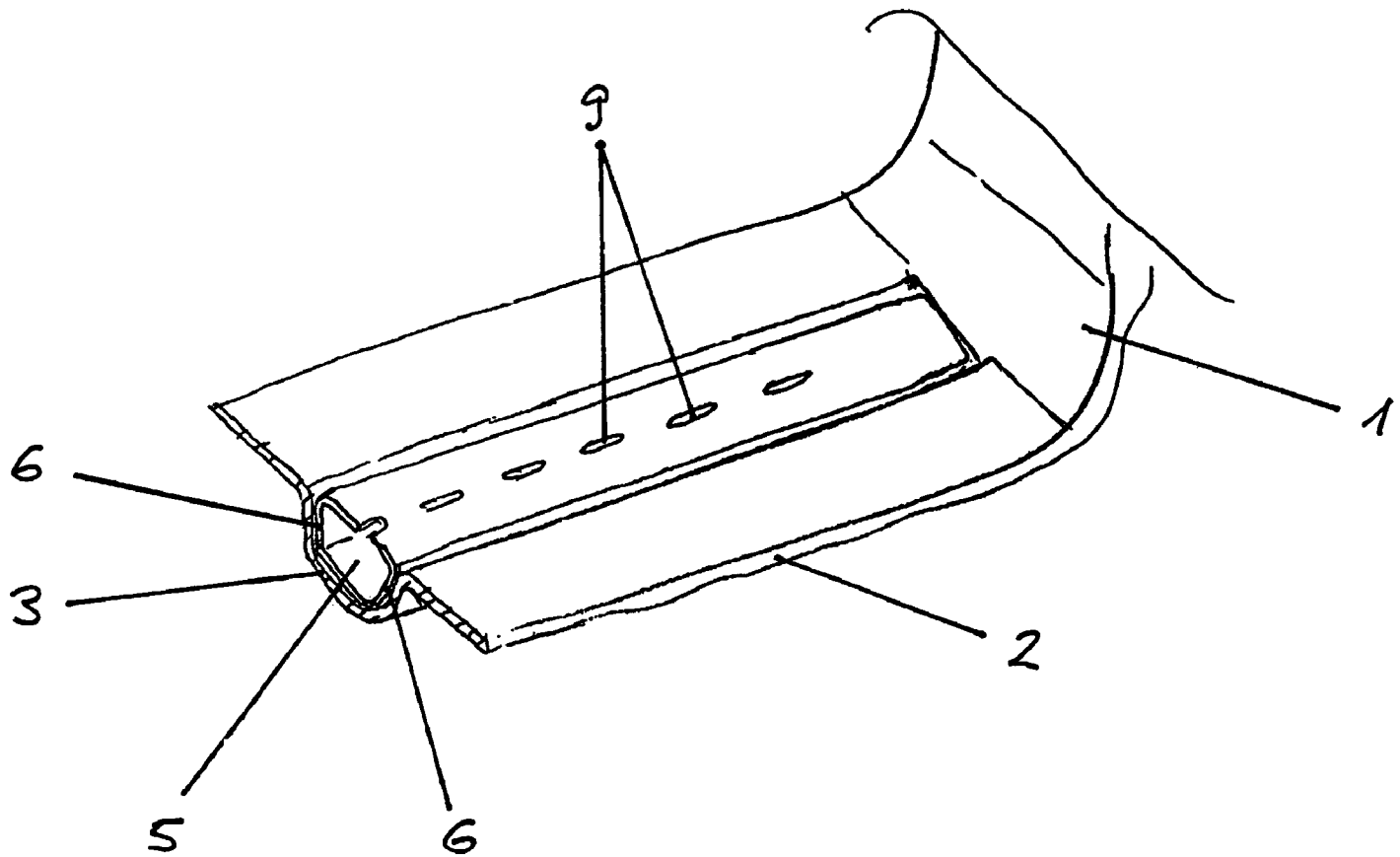
Figure 4:
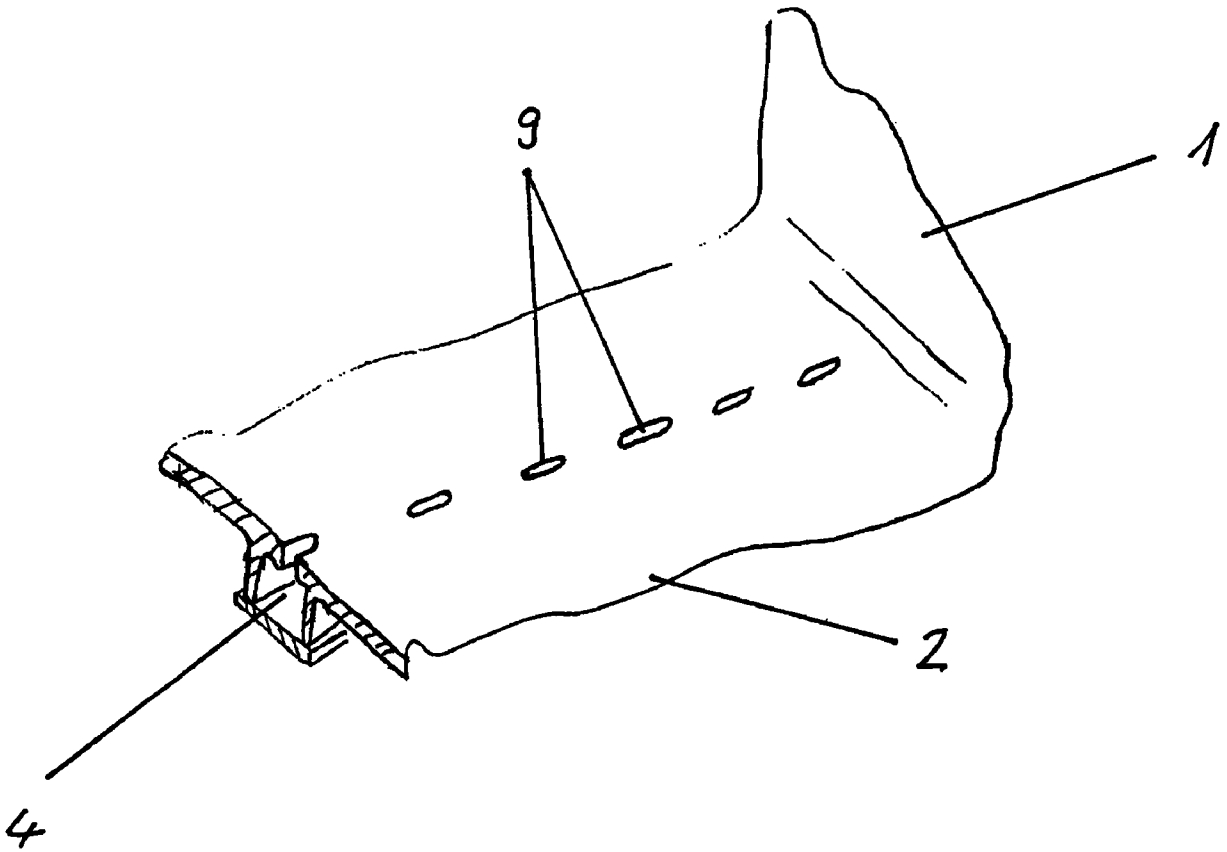
Figure 5:
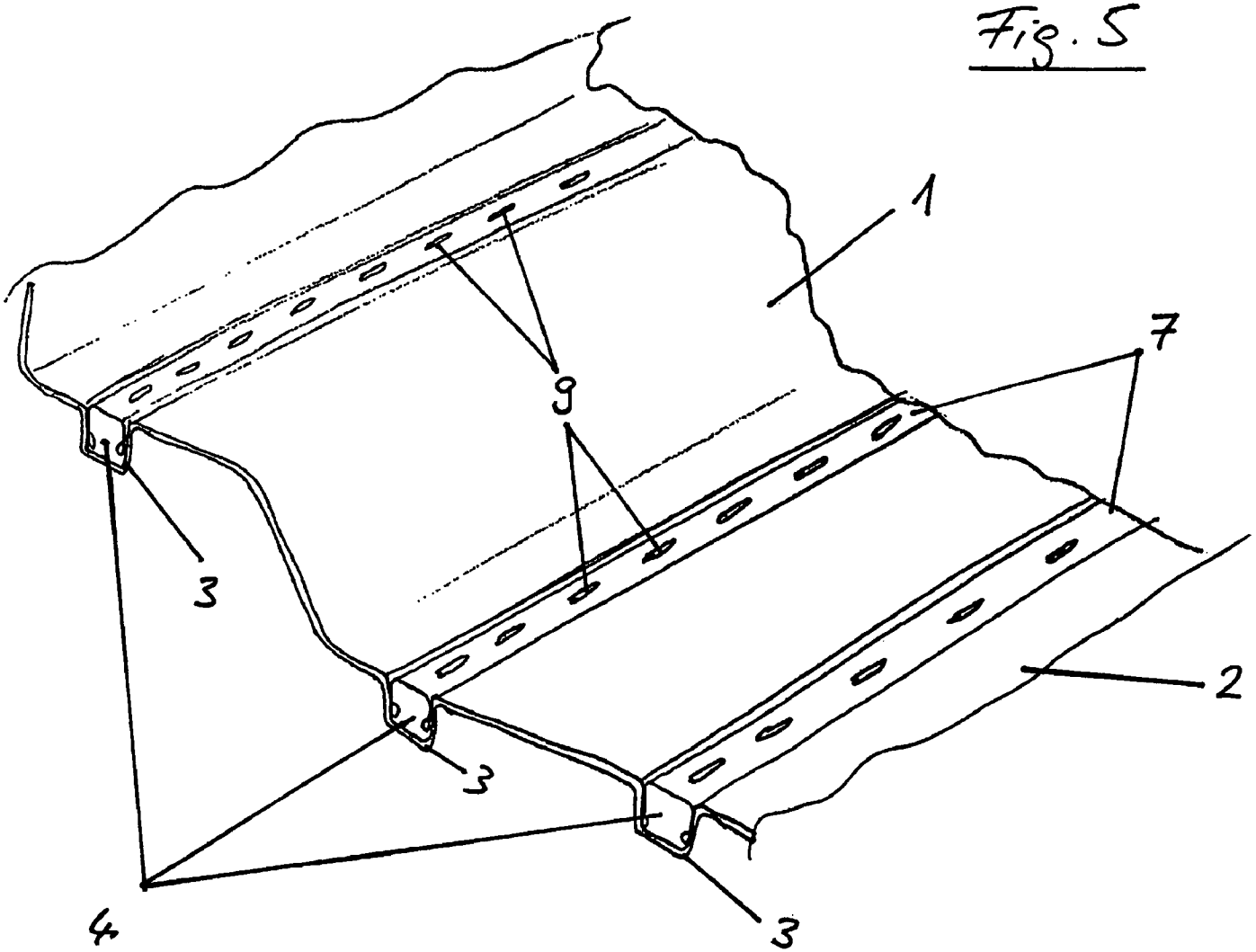

The present invention is explained in detail hereinafter using preferred exemplary embodiment with reference to the appended drawings. In the figures FIG. 1 is a partial sectional view of the bottom of the washing container of a dishwasher with a spray device according to a first embodiment of the present invention, FIG. 2 is a second partial sectional view of the bottom of the washing container of a dishwasher with a spray device according to the embodiment shown in FIG. 1, FIG. 3 is a partial sectional view of the bottom of the washing container of a dishwasher with a spray device according to a second embodiment of the present invention, FIG. 4 is a partial sectional view of the bottom of the washing container of a dishwasher with a spray device according to a third embodiment of the present invention and FIG. 5 is a partial sectional view of the bottom of the washing container of a dishwasher with a spray device according to a fourth embodiment of the present invention.

FIG. 1 shows part of the washing container 1 of a dishwasher with a spray device according to a first embodiment of the present invention. A sectional view shows part of the bottom 2 of the washing container 1 wherein an indentation 3 is provided in the form of a groove. Located on the indentation 3 in the bottom 2 of the washing container 1 is a removable cover 7 which covers the indentation 3 over its entire length. The indentation 3 in cooperation with the cover 7 thus forms a spray channel 4 to which washing liquid is supplied by means of the circulating pump during operation for example. Provided in the cover 7 are openings 9 for passage of washing liquid from the spray channel 4 into the interior of the washing container 1.

In this first embodiment the cover 7 has a symmetrical and substantially U-shaped cross-section where the two free ends of the U-shaped cross-section are formed by legs 8. The cover 7 is made of an elastic material so that the legs 8 can be bent flexibly towards one another against a pre-stress. In this way, a clamping connection is formed between the legs 8 and the side wall 6 of the spray channel whereby the cover 7 is fixed in the bottom 2 of the washing container 1 on the spray channel 4. The removable cover 7 of the spray channel 4 makes it possible to remove this like a cover from the spray channel 4 if required in order to inspect the interior of the spray channel 4 or remove deposits or attach a different cover 7.

Figure 2:
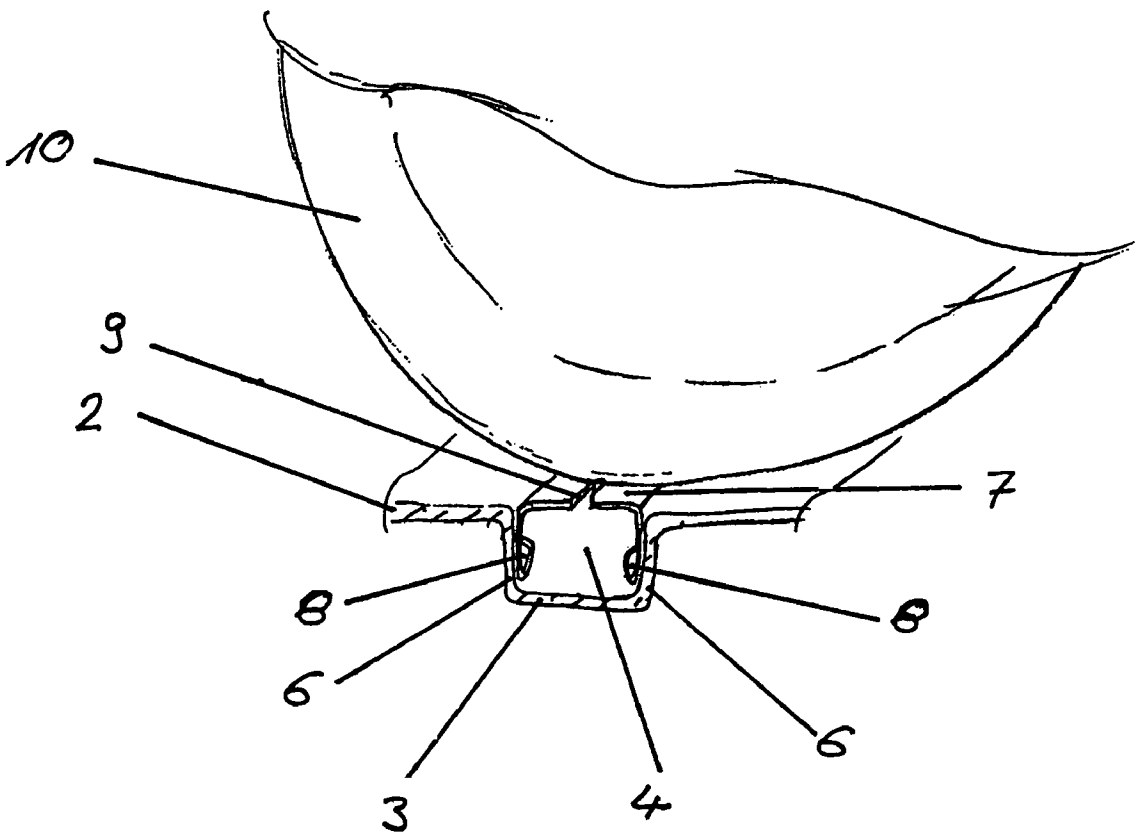

FIG. 2 shows a second partial sectional view of the bottom 2 of the washing container 1 of a dishwasher with a spray device according to the embodiment shown in FIG. 1. In this case, it can be seen in FIG. 1 that the indentation 3 in the bottom 2 of the washing container 1 constitutes a spray channel 4 which is closed by the cover 7 towards the interior of the washing container 1. The cover is fixed by means of the clamping connection between the two legs 8 and the side walls 6 of the spray channel 4. Located in the cover 7 are openings 9 for passage of the washing liquid from the spray channel 4 into the interior of the washing container 1.

It can be seen clearly from FIG. 2 that the cover 7 and therefore the side of the spray channel directed towards the interior of the washing container 1 lie substantially in one plane with the bottom 2 of the washing container 1. This results in a flat surface over the entire bottom 2 of the washing container 1 which allows a largely arbitrary arrangement of items to be washed 10 in the immediate vicinity of the bottom 2 of the washing container 1. Since the openings 7 are distributed over the entire length of the spray channel 4, the possibility of spray jets being "shaded" by items to be washed 10 is reduced. Even when items to be washed 10 are placed directly on the spray channel 4, as a result of the elongated shape of the openings 9 washing liquid can still be sprayed from the spray channel 4 into the washing container 1.

FIG. 3 shows a partial sectional view of the bottom 2 of the washing container 1 of a dishwasher with a spray device according to a second embodiment of the present invention. In this second embodiment the spray channel 5 is constructed as closed, the side of the spray channel 5 facing the interior of the washing container 1 having openings 9 for the passage of washing liquid. The spray channel 5 is further configured so that it can be released manually from the bottom 2 of the washing container 1 and can be fixed again by means of a clamping connection. It is thereby possible to remove the spray channel 5 from the washing container 1 if required to free it from deposits for example or to replace it by another spray channel 5. In the first embodiment shown in FIGS. 1 and 2 the spray channel 4 has a substantially rectangular, almost square cross-section. In the second embodiment shown in FIG. 3 the spray channel 5 has a trapezoidal cross section where the distance between the side walls 6 of the spray channel 5 tapers from the side of the spray channel 5 facing the interior of the washing container 1 to the side of the spray channel 5 facing away from the interior of the washing container 1.

Unlike that selected here from practical considerations, such a spray channel can however also be provided with a round or at least partly round, preferably circular round cross section. This would improve the hydraulic parameters although it is more complex to manufacture.

FIG. 4 shows a partial sectional view of the bottom 2 of the washing container 1 of a dishwasher with a spray device according to a third embodiment of the present invention. In this third embodiment the side of the spray channel 4 directed towards the interior of the washing container 1 is formed by the bottom 2 of the washing container 1 where the bottom 2 has openings 9 for passage of the washing liquid in the area of the spray channel 4. In addition, the remaining walls of the spray channel 4 and therefore the spray channel 4 as a whole can be constructed in one piece with the bottom 2 of the washing container 1 where the openings 9 for passage of the washing liquid are either inserted subsequently or provided during manufacture of the washing container 1.

FIG. 5 shows a partial sectional view of the bottom 2 of the washing container 1 of a dishwasher with a spray device according to a fourth embodiment of the present invention. The configuration of the spray channels 4 substantially corresponds to the embodiment shown in FIGS. 1 and 2. In this fourth embodiment the washing container 1 is constructed as trough-shaped where a number of indentations, provided with covers 7, preferably aligned parallel to one another are provided in the bottom 2 of the washing container 1. The indentations 3 together with the covers 7 form spray channels 4 which are integrated in the bottom 2 of the washing container 1 in this way. In principle, the number of spray channels 4 should be adapted to the volume of the washing container 1 or to the surface of the dishwasher bottom 2. The bottom 2 of the washing container 1 is formed such that the spray channels 4 lie on different planes and therefore several spraying levels are formed. The installation of a plurality of spray channels 4, 5 promotes a uniform spray distribution of the washing liquid in the washing container 1 which is further improved by the arrangement of the spray channels 4 at different heights.

REFERENCE LIST

1 Washing container
2 Bottom of washing container
3 Indentation in bottom of washing container
4 Spray channel with rectangular cross-section
5 Spray channel with conical cross-section
6 Side wall of spray channel
7 Cover of spray channel
8 Legs of cover of the spray channel
9 Openings for passage of washing liquid
10 Items to be washed

The invention claimed is:

1. A dishwasher comprising:

at least one washing container having a bottom area, a top area, and a wall area that collectively form an interior of the washing container in which items to be washed can be disposed; and a spraying device for spraying washing liquid into the interior of the washing container, the spraying device having at least one spray channel operable to guide therealong a washing liquid, the spray channel being integrated into at least one of the bottom, top and wall areas of the washing container and having openings in a side of the spray channel oriented in a direction towards the interior of the washing container for the passage therethrough of washing liquid, wherein the spraying device includes a spray cover having a substantially U-shaped cross-section, and wherein free ends of the U-shaped spray cover are bent inward to fit the spray cover into the spray channel such that outward deflection of the free ends abuts the free ends against side walls of the spray channel.

2. The dishwasher according to claim 1, wherein the spray channel is tubular and has a configuration of two open ends via which the washing liquid can be supplied under the action of pressure.

3. The dishwasher according to claim 1, wherein the spray channel is operable to guide therethrough washing liquid which is being supplied at various pressures.

4. The dishwasher according to claim 3, wherein the spray channel is operable to guide therethrough washing liquid which is being supplied at various pressures wherein the variation of the pressure is controlled by a pressure distribution using at least one of an electronic, hydraulic and mechanical means.

5. The dishwasher according to claim 1, wherein the spray channel has a round cross-section.

6. The dishwasher according to claim 1, wherein the spray channel has a rectangular cross-section.

7. A dishwasher comprising:

at least one washing container having a bottom area, a top area, and a wall area that collectively form an interior of the washing container in which items to be washed can be disposed; and a plurality of spraying devices for spraying washing liquid into the interior of the washing container, each of the plurality of spraying devices having at least one spray channel operable to guide therealong a washing liquid, the spray channel being integrated into at least one of the bottom, top and wall areas of the washing container and having openings in a side of the spray channel oriented in a direction towards the interior of the washing container for the passage therethrough of washing liquid, wherein the spraying devices lie in different planes within the washing container, and wherein at least the bottom area of the washing container has a multi-planar surface, each side of the spray channels directed toward the interior of the washing container lying in one plane and defining a substantially continuous planar surface with the bottom area of the washing container.

8. The dishwasher according to claim 7, wherein the spray channel is tubular and has a configuration of two open ends via which the washing liquid can be supplied under the action of pressure.

9. The dishwasher according to claim 7, wherein the spray channel is operable to guide therethrough washing liquid which is being supplied at various pressures.

10. The dishwasher according to claim 9, wherein the spray channel is operable to guide therethrough washing liquid which is being supplied at various pressures wherein the variation of the pressure is controlled by a pressure distribution using at least one of an electronic, hydraulic and mechanical means.

11. The dishwasher according to claim 7, wherein the spray channel has a round cross-section.

12. The dishwasher according to claim 7, wherein the spray channel has a rectangular cross-section.

* * * * *